US008342092B2

(12) United States Patent
Kasper et al.

(10) Patent No.: US 8,342,092 B2
(45) Date of Patent: Jan. 1, 2013

(54) POROUS ROLL WITH AXIAL ZONES AND METHOD OF PROVING PRINTING LIQUID TO A CYLINDER IN A PRINTING PRESS

(75) Inventors: Kent Dirksen Kasper, Lee, NH (US); Lawrence Edward Zagar, Dover, NH (US); David Robert Dawley, Rochester, NH (US); Aaron Christian Sakash, Somersworth, NH (US)

(73) Assignee: Goss International Americas, Inc., Durham, NH (US)

( * ) Notice: Subject to any disclaimer, the term of this patent is extended or adjusted under 35 U.S.C. 154(b) by 923 days.

(21) Appl. No.: 12/313,565

(22) Filed: Nov. 21, 2008

(65) Prior Publication Data

US 2010/0126366 A1 May 27, 2010

(51) Int. Cl.
*B41F 31/02* (2006.01)
*B41F 31/00* (2006.01)

(52) U.S. Cl. ..... 101/367; 101/366

(58) Field of Classification Search ..... 101/367, 101/366, 365, 147; 492/18
See application file for complete search history.

(56) References Cited

U.S. PATENT DOCUMENTS

| | | | | | |
|---|---|---|---|---|---|
| 1,214,787 | A | * | 2/1917 | Hoe | 101/363 |
| 1,275,256 | A | * | 8/1918 | Hoe | 101/367 |
| 2,300,949 | A | | 11/1942 | Luehrs | |
| 2,319,615 | A | * | 5/1943 | Luchrs | 101/367 |
| 2,319,616 | A | * | 5/1943 | Luehrs | 101/367 |
| 2,913,980 | A | | 11/1959 | Lindemann | |
| 3,083,642 | A | | 4/1963 | Birk et al. | |
| 3,738,269 | A | * | 6/1973 | Wagner | 101/367 |
| 3,889,597 | A | | 6/1975 | Charlton | |
| 4,483,053 | A | * | 11/1984 | Hamisch, Jr. | 29/895.21 |
| 5,016,530 | A | | 5/1991 | Palmatier | |
| 5,036,761 | A | | 8/1991 | Wingo | |
| 5,282,419 | A | * | 2/1994 | Barrois | 101/367 |
| 6,234,078 | B1 | * | 5/2001 | Kessler | 101/351.6 |
| 2002/0014171 | A1 | * | 2/2002 | Konrad et al. | 101/350.1 |
| 2007/0068410 | A1 | * | 3/2007 | Roland | 101/365 |

FOREIGN PATENT DOCUMENTS

| | | | |
|---|---|---|---|
| DE | 3806466 | A1 | 9/1989 |
| GB | 2314292 | A * | 12/1997 |
| JP | 61-141558 | | 6/1986 |
| JP | 2007-264362 | | 10/2007 |

* cited by examiner

*Primary Examiner* — Matthew G Marini
*Assistant Examiner* — Leo T Hinze
(74) *Attorney, Agent, or Firm* — Davidson, Davidson & Kappel, LLC

(57) ABSTRACT

A roll for distributing printing liquid in a printing press is provided. The roll includes a roll core having at least a first and a second axial zone, a first liquid feed for feeding liquid to the first axial zone, a second liquid feed for feeding the liquid to the second axial zone independent of the first axial zone and a porous shell covering the first and second axial zones. A printing press, a method for providing printing liquid through a porous shell of a printing liquid supply roll to a cylinder of a printing press, an inking apparatus and a method for providing ink to an anilox roll are also provided.

15 Claims, 10 Drawing Sheets

POROUS ROLL WITH AXIAL ZONES AND METHOD OF PROVING PRINTING LIQUID TO A CYLINDER IN A PRINTING PRESS

The present invention relates generally to printing presses, and more particularly to ink and dampening fluid metering devices for printing presses.

BACKGROUND OF THE INVENTION

Printing processes, such as the lithographic web offset process, commonly use an arrangement of rollers called an inker to accept ink from an ink metering device and deliver it to a printing plate. A goal of the inker is to supply the plate with a thin, uniform film of ink. An inker may contain as many as twenty rollers to achieve this goal.

One reason for the large number of rollers in an inker is that the ink feed from prior art ink metering devices, such as ink fountains, ductors, and metering rolls, is intermittent. Typically the ink is supplied by the ink metering device in the form of stripes or spots spaced about two or more inches apart in the circumferential direction on the first inker roll. An inker contains extra rollers to filter out these spots or stripes so that the plate receives a uniform ink film and the spots or stripes do not appear in the print.

To produce a high quality printed product, most ink metering devices allow the feed rate of ink into the inker to be varied laterally across the web or sheet. Typically the metering device is divided into separate lateral zones about one or two inches in width, with the ink feed in each zone being separately controllable.

Printing processes, such as the lithographic web offset process, commonly use an arrangement of rollers called a dampener. The goal of the dampener is to deliver a thin, uniform film of dampening fluid to a printing plate. Typical prior art dampeners are of two basic types, generally called spray dampeners and pan-roll dampeners. Spray dampeners typically have the dampening fluid sprayed onto the first dampener rollers. Pan-roll dampeners typically transfer the dampening fluid onto the first dampener rollers from a pan-roller which is partially submerged in a pan containing dampening fluid.

To transfer more or less dampening fluid on a localized lateral area of the lithographic printing plate, the typical pan-roll dampeners has only roller-squeeze and roller-skew for coarse adjustments. The typical spray dampener accomplishes lateral control for localized areas by varying the fluid flow rate through laterally spaced spray nozzles. The typical spray dampeners also have over-spray issues and rely on the sprayed fluid to adhere to the dampener rollers.

Printing processes, such as the flexographic printing process, commonly use an engraved anilox roller to deliver a quantity of ink from an ink chamber to a flexographic printing plate. The raised image sections of the flexographic printing plate then transfer a portion of the ink delivered by the anilox roll to the substrate being printed.

The goal of the anilox roller is to supply the flexographic printing plate a quantity of ink proportional to the volume of the engraved anilox cells. The goal of the flexographic printing plate is to selectively transfer a portion of the ink delivered by the anilox roll to the printing substrate.

To transfer more or less ink on a localized lateral area of the substrate being printed, typically the flexographic printing plate is replaced by another flexographic printing plate having a larger or smaller image transfer areas.

To transfer more or less ink laterally uniform across the substrate being printed, typically the engraved anilox roller is replaced by another engraved anilox roller having a larger or smaller engraved anilox cell volume.

SUMMARY OF THE INVENTION

A roll for distributing printing liquid in a printing press is provided. The roll includes a roll core having at least a first and a second axial zone, a first liquid feed for feeding liquid to the first axial zone, a second liquid feed for feeding the liquid to the second axial zone independent of the first axial zone and a porous shell covering the first and second axial zones.

A printing press is also provided. The printing press includes a plate cylinder, a printing liquid supply roll and at least one printing liquid pump. The printing liquid supply roll forms a nip with the plate cylinder and includes an interior region and a porous layer surrounding the interior region. The at least one printing liquid pump is adapted to pump printing liquid into the interior region and through the porous layer. The printing liquid supply roll is adapted to transfer the printing liquid to the plate cylinder at the nip.

A method for providing printing liquid through a porous shell of a printing liquid supply roll to a cylinder of a printing press is also provided. The method includes the steps of rotating the printing liquid supply roll; supplying the printing liquid into the inside of the printing liquid supply roll; feeding the printing liquid from the inside of the printing liquid supply roll through the porous shell; and transferring the printing liquid from the printing liquid supply roll to the cylinder.

An inking apparatus for a printing press is also provided. The inking apparatus includes an anilox roll and at least one ink pump. The anilox roll includes an interior region, a porous layer surrounding the interior region and an outer surface of engraved cells surrounding the porous layer. The at least one ink pump is adapted to pump ink into the interior region and through the porous coating to the outer surface of engraved cells.

A method for providing ink to an anilox roll is also provided. The method includes the steps of rotating the anilox roll; filling engraved cells of the anilox roll with ink from outside of the anilox roll; removing any excess ink from the anilox roll with a doctor blade; and providing additional ink to the engraved cells from the inside of the anilox roll.

BRIEF DESCRIPTION OF THE DRAWINGS

The present invention is described below by reference to the following drawings, in which.

DETAILED DESCRIPTION

Figure 1:
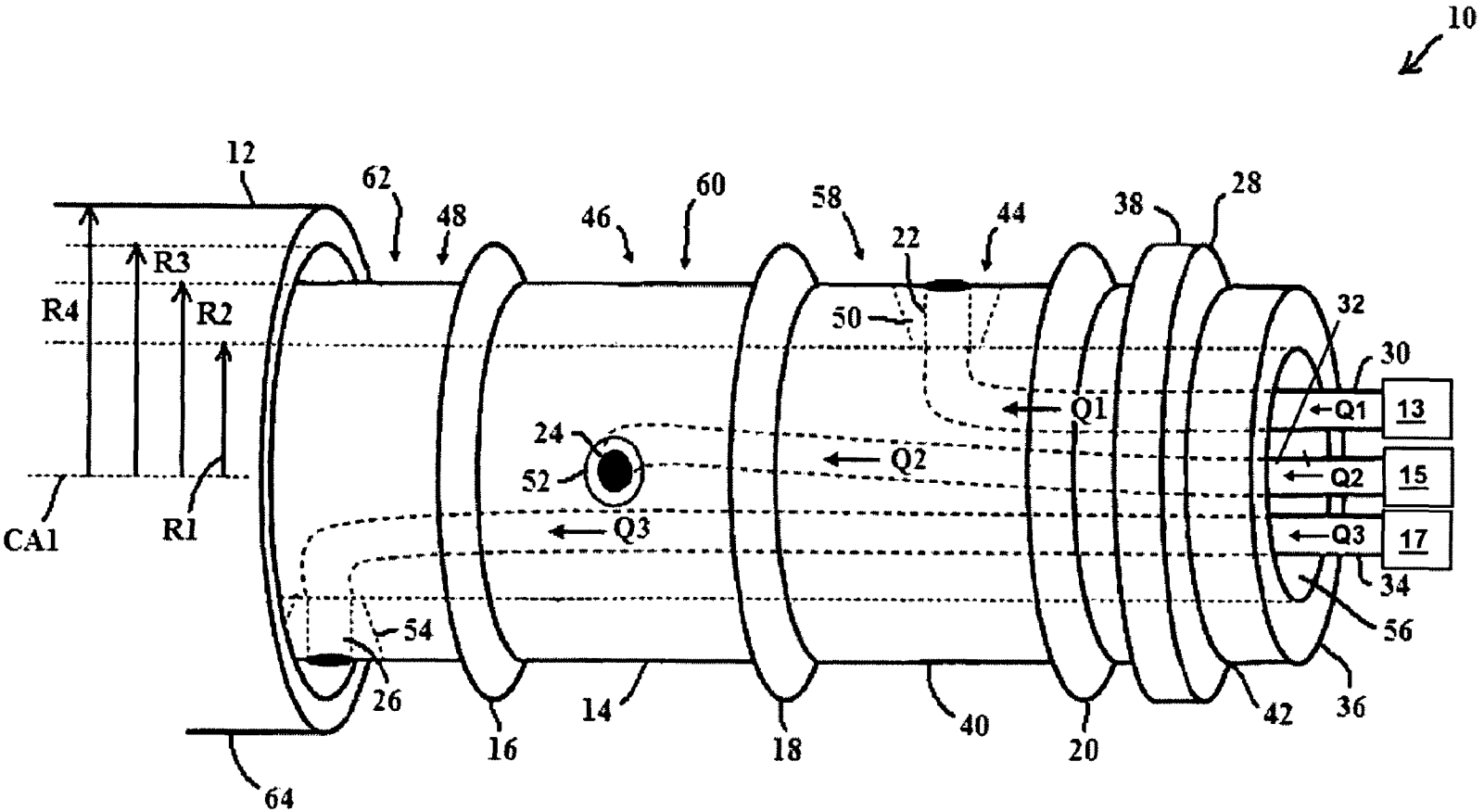
FIG. 1 shows a schematic perspective view of a porous roll with axial zones according to an embodiment of the present invention.

FIG. 1 shows a schematic perspective view of a porous roll 10 with axial zones 44, 46, 48 according to an embodiment of the present invention. Porous roll 10 includes a porous shell 12, a roll core 14, seals 16, 18, 20, fittings 22, 24, 26, a bearing 28, and interior tubes 30, 32, 34. For clarity, FIG. 1 shows only one axial end of porous roll 10, and porous shell 12 has been moved axially away from an axial edge 36 to expose roll core 14, seals 16, 18, 20, fittings 22, 24, 26, and bearing 28. Porous roll 10 may be used to distribute ink or dampening fluid in a printing press.

Porous shell 12 is supported by an outer race 38 of bearing 28 near edge 36 of roll core 14. Porous shell 12 may be supported by one or more additional bearings on roll core 14. Porous shell 12 is free to rotate around a center axis CA1.

Roll core 14 has an outer surface 40 supporting an inner race 42 of bearing 28 and seals 16, 18, 20. Seals 16, 18, 20 form the axial boundaries of axial zones 44, 46, 48. Axial zones 44, 46, 48 have holes 50, 52, 54, respectively, extending from outer surface 40 to an inner radius RI of roll core 14. Holes 50, 52, 54 contain fittings 22, 24, 26 attached to interior tubes 30, 32, 34, respectively. Interior tubes 30, 32, 34 extend through a hole 56 at edge 36 and are coupled to liquid pumps 13, 15, 17, respectively. Interior tubes 30, 32, 34 may act as liquid feeds to axial zones 44, 46, 48. The liquid may be conveyed in interior tubes 30, 32, 34 or roll core 14 may be solid and liquid may be conveyed in channels machined directly into roll core 14, for example as channels 116, 118, 120 of FIG. 2.

During operation of porous roll 10, liquid is pumped at controlled liquid flow rates Q1, Q2, Q3 through respective interior tubes 30, 32, 34 and into respective axial zones 44, 46, 48. In each axial zone 44, 46, 48, the liquid may fill respective interior regions 58, 60, 62 between an outer radius R2 of roll core 14, and an inner radius R3 of porous shell 12. Seals 16, 18, 20 prevent liquid from flowing axially between axial zones 44, 46, 48. Liquid flows radially from interior regions 58, 60, 62 through porous shell 12 to an outer surface 64 of porous shell 12 at an outer radius R4. Liquid transfers from outer surface 64 to an adjacent inker roll or dampener roll, at a region of contact, or contacting nip, formed between outer surface 64 and the adjacent roll.

By constructing porous roll 10 with porous shell 12, liquid transfer from porous roll 10 to an adjacent roll is quasi-continuous. Porous roll 10 can advantageously improve the uniformity of liquid supplied to the printing plate and allows the number of rollers in an inker or dampener to be reduced.

Liquid delivered by porous roll 10 into an inker or dampener is pre-metered by liquid pumps 13, 15, 17 coupled to respective interior tubes 30, 32, 34. At steady state operation, a flowrate of liquid out of outer surface 64 and to an adjacent roll in axial zones 44, 46, 48 is equal to liquid flowrates Q1, Q2, Q3, respectively. Porous roll 10 thus advantageously can reduce or eliminate the intermittent liquid feed.

While FIG. 1 shows only three axial zones 44, 46, 48, porous roll 10 may contain as many zones as needed for the desired print quality. As more axial zones are added, additional liquid pumps, interior tubes, seals, and fittings are added accordingly. Additional interior tubes or channels may also enter through the opposite axial end of roll core 14. Porous shell 12 may be of composite construction, or may alternately be comprised of multiple cylindrical elements.

In the embodiment in FIG. 1, porous shell 12 is free to rotate around center axis CA1 while roll core 14 does not rotate around center axis CA1. In another embodiment, shown in FIG. 2, a porous shell 82 and a roll core 84 are both free to rotate together around a center axis CA2.

Figure 2:
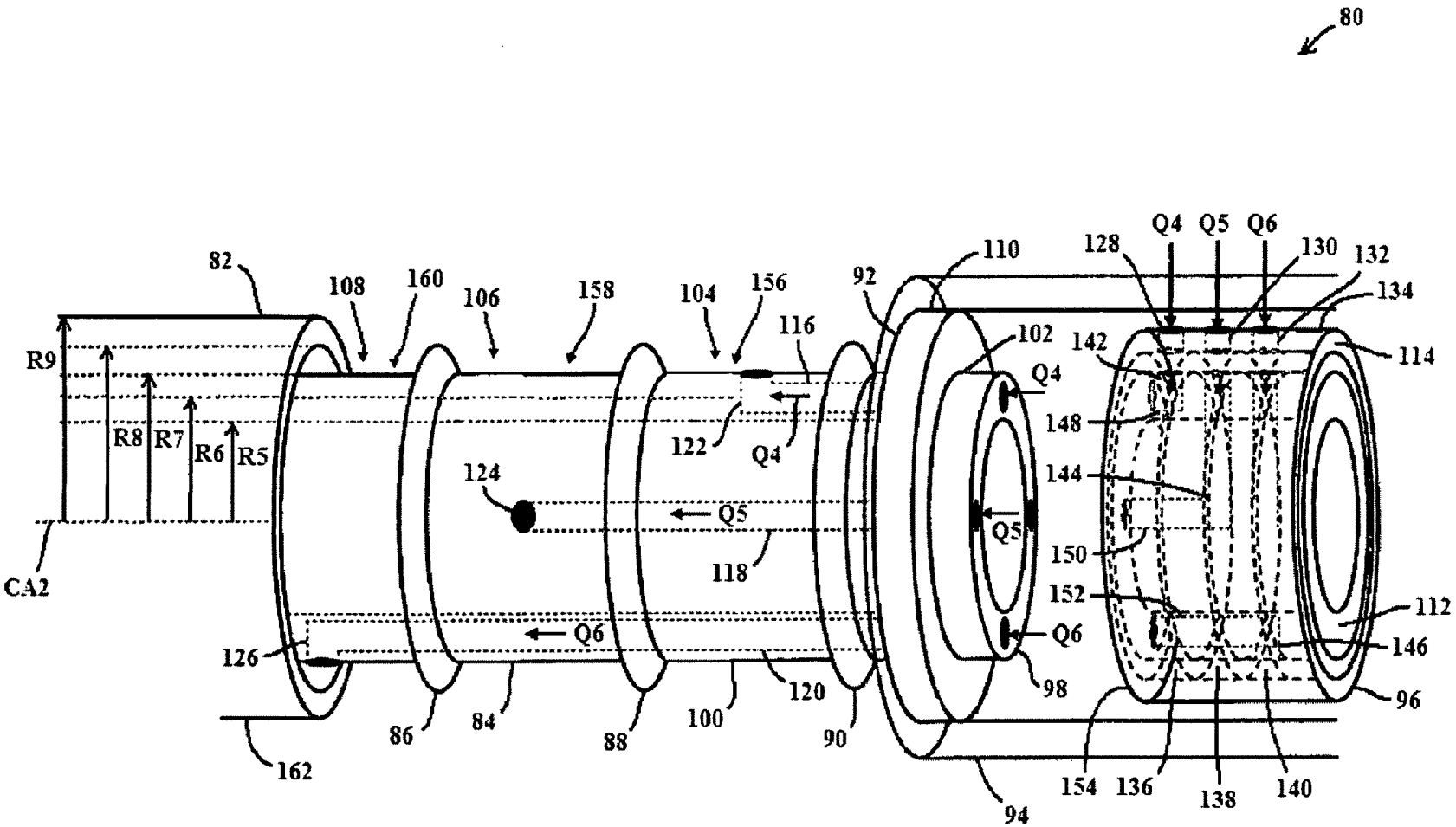
FIG. 2 shows a schematic perspective view of a porous roll with axial zones according to another embodiment of the present invention.

FIG. 2 shows a schematic perspective view of a porous roll 80 with axial zones 104, 106, 108 according to another embodiment of the present invention. Porous roll 80 includes porous shell 82, roll core 84, seals 86, 88, 90, a bearing 92, a bearing hanger 94, and a rotary union 96. For clarity, FIG. 2 shows only one axial end of porous roll 80, and porous shell 82 has been moved axially away from an axial edge 98 to expose roll core 84 and seals 86, 88, 90.

Roll core 84 has an outer surface 100 supporting an inner race 102 of bearing 92 and seals 86, 88, 90. Seals 86, 88, 90 form the axial boundaries of axial zones 104, 106, 108. An outer race 110 of bearing 92 is supported by bearing hanger 94.

Porous shell 82, roll core 84, seals 86, 88, 90, inner race 102 of bearing 92, and an inner race 112 of rotary union 96 are free to rotate about a center axis CA2. Outer race 110 of bearing 92, an outer race 114 of rotary union 96, and bearing hanger 94 are not free to rotate about center axis CA2.

Roll core 84 has channels 116, 118, 120 extending in the axial direction from axial edge 98 to axial zones 104, 106, 108. Channels 116, 118, 120 act as liquid feeds for respective axial zones 104, 106, 108 and are machined into roll core 84. Roll core 84 also has holes 122, 124, 126 extending in the radial direction to connect outer surface 100 with respective channels 116, 118, 120.

Rotary union 96 allows liquid to be pumped from a non-rotating liquid pump into channels 116, 118, 120 of roll core 84 as roll core 84 is rotating about center axis CA2. For illustration purposes, rotary union 96 is shown detached from roll core 84 in FIG. 2. One or more liquid pumps are coupled to holes 128, 130, 132 in outer race 114 of rotary union 96 and supply liquid to holes 128, 130, 132. Holes 128, 130, 132 extend in the radial direction from an outer surface 134 of rotary union 96 to annular channels 136, 138, 140 between inner race 112 and outer race 114. Holes 142, 144, 146 extend in the radial direction from annular channels 136, 138, 140 to a radial location of radius R6. Also at the radial location of radius R6, holes 148, 150, 152 extend in the axial direction from holes 142, 144, 146 to an axial edge 154. By aligning holes 148, 150, 152 with channels 116, 118, 120 and attaching rotary union 96 to roll core 84, liquid may be pumped from the one or more liquid pumps, through rotary union 96, and out of holes 122, 124, 126 in roll core 84.

During operation of porous roll 80, liquid is pumped at controlled liquid flowrates Q4, Q5, Q6 through holes 122, 124, 126 and into axial zones 104, 106, 108. In each axial zone, the liquid may fill regions 156, 158, 160 between an outer radius R7 of roll core 84, and an inner radius R8 of porous shell 82. Seals 86, 88, 90 prevent liquid from flowing axially between axial zones 104, 106, 108. Liquid flows radially from regions 156, 158, 160 through porous shell 82 to an outer surface 162 of porous shell 82 at an outer radius R9.

Liquid transfers from outer surface 162 to an adjacent inker roll or dampener roll at a region of contact, or contacting nip, formed between outer surface 162 and the adjacent roll.

By constructing porous roll 80 with porous shell 82, liquid transfer from porous roll 80 to the adjacent roll is quasi-continuous. Porous roll 80 may advantageously improve the uniformity of liquid supplied to the printing plate and may allow the number of rollers in an inker or dampener to be reduced.

Liquid delivered by porous roll 80 into an inker or dampener is pre-metered by the one or more liquid pumps connected to holes 128, 130, 132. At steady state operation, a flowrate of liquid out of outer surface 162 and to the adjacent roll in axial zones 104, 106, 108 is equal to liquid flowrates Q4, Q5, Q6, respectively. Porous roll 80 thus advantageously can reduce or eliminate the intermittent liquid feed.

While FIG. 2 shows only three axial zones 104, 106, 108, porous roll 80 may contain as many zones as needed for the desired print quality. As more zones are added, additional liquid pumps, channels, seals, and fittings are added accordingly. Additional channels may also enter through the opposite axial end of roll core 84.

Figure 3A:
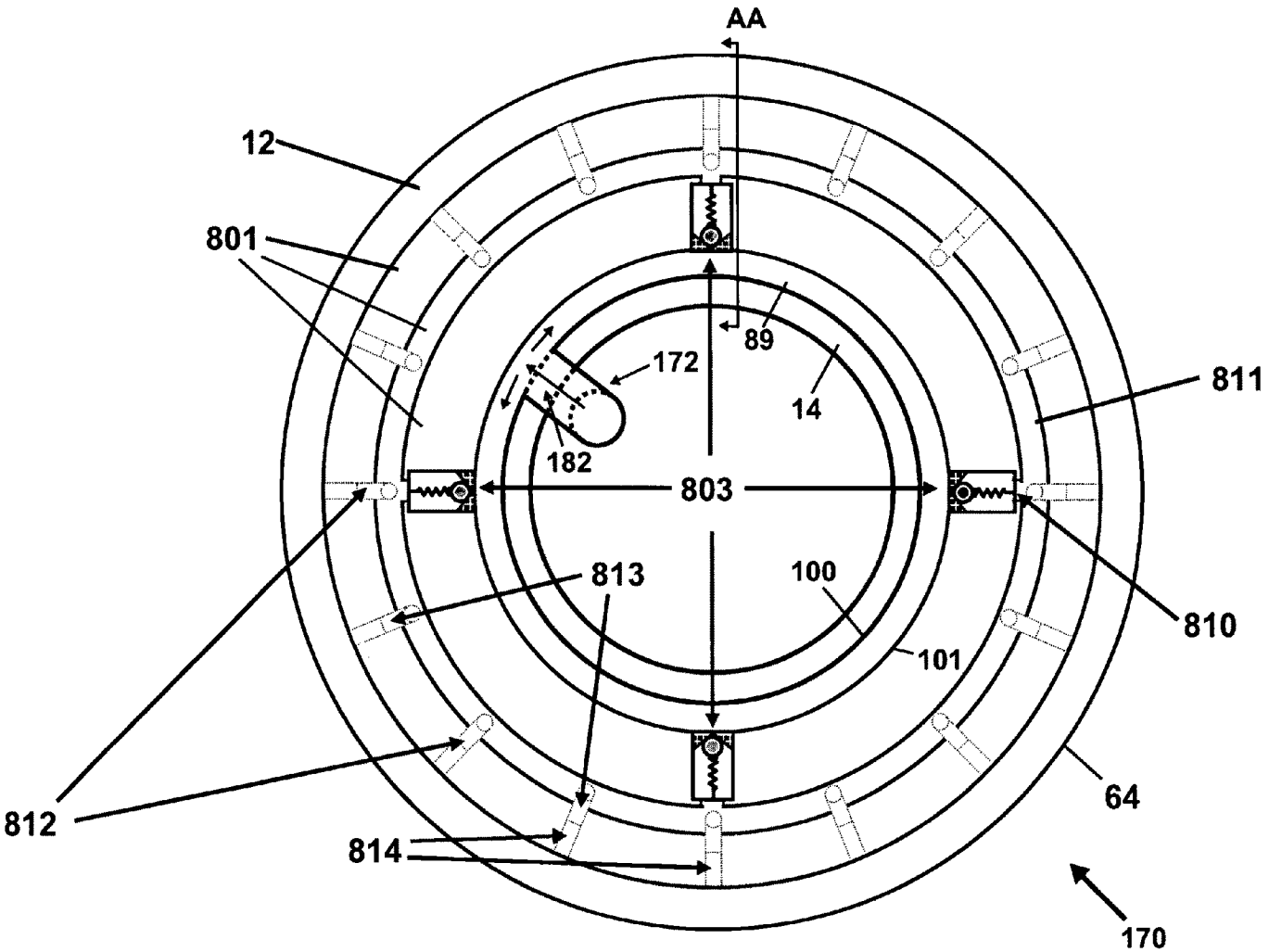
FIG. 3*a* shows a schematic view of an axial cross-section of a porous roll according to another embodiment of the present invention.

FIG. 3*a* shows a schematic view of an axial cross-section of a porous roll 170 according to another embodiment of the present invention. Porous roll 170 is similar to porous roll 10 shown in FIG. 1 and includes roll core 14 and porous shell 12. Similar to porous roll 10 shown in FIG. 1, in porous roll 170, liquid may be fed to a plurality of axial zones of porous roll 170 via interior tubes. FIG. 3*a* shows a cross section of a single axial zone being fed liquid by an interior tube 172 to a hole 182 in roll core 14. Interior tube 172 transports liquid from an axial direction and then radially towards hole 182. Interior tube 172 may be similar to interior tube 32 (FIG. 1), and hole 182 may be similar to hole 52 (FIG. 1). In an alternative embodiment, roll core 14 may be solid and interior tube 172 may be a channel machined into roll 14. The view in FIG. 3*a* splits down a center of hole 182. Porous roll 170 includes a distribution ring 801 between a liquid flow region 89 and porous shell 12. Liquid flow region 89 is defined by an inner surface 101 of distribution ring 801 and an outer surface 100 of role core 14 and allows liquid to flow circumferentially around outer surface 100 of role core 14.

Flow into distribution ring 801 may be regulated by one or more pressure relief or check valves 803. Pressure relief valves 803 require liquid to exceed a pre-determined pressure value before the valves 803 will open. By proper selection of this value, liquid can be fully distributed axially and circumferentially in the axial zone before the one of more valves 803 open. Multiple valves 803 may be employed (FIG. 3*b*) to adequately distribute the liquid. Liquid passing through valves 803 enters an inner channel 811 through a passage 810. Inner channel 811 may be configured to allow liquid to flow in circumferential and axial directions with respect to a center axis of porous roll 170. Liquid may then travel through flow distribution tubes 812, 813, which may alternate about the center axis of porous roll 170 to distribute liquid to from inner channel 811 to respective surface channels 814, which run parallel to the center axis of porous roll 170 and provide ink to porous shell 12. Liquid may then be transferred through outer surface 64 to an adjacent roll. Distribution tubes 812, 813 may alternate at constant angle around roll 170, meaning surface channels 814 are fed from alternating axial directions. The number of pressure relief valves 803 and the number of surface channels 814 need not be equal.

Figure 3B:
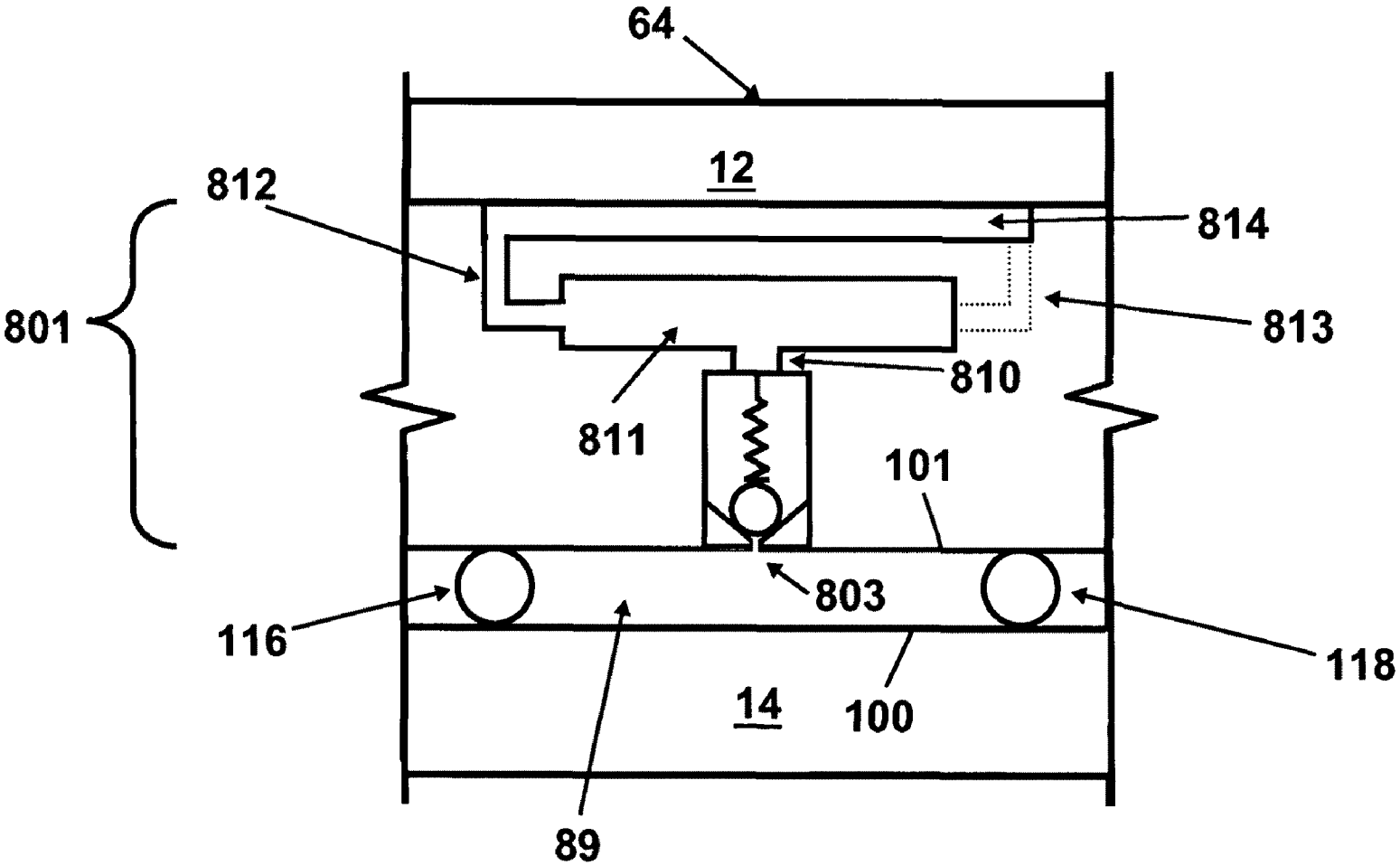
FIG. 3*b* shows a schematic view of a cross section of porous roll shown in FIG. 3*a;*

FIG. 3*b* shows a schematic view of a cross section of porous roll 170 along AA of FIG. 3*a*. The outer wall of roll core 14 and the inner wall of liquid distribution ring 801 are attached to two sealing elements 116, 118 which prevent liquid from flowing between liquid flow region 89 and liquid flow regions of adjacent axial zones. Once liquid in liquid flow region 89 exceeds a pre-determined pressure value and pressure relief valve 803 has opened, liquid flows through passage 810 into inner channel 811, distributing laterally and circumferentially. Once liquid arrives at the extreme lateral extents of inner channel 811, liquid flows into distribution tubes 812, 813. Distribution tube 813 is shown dotted because it is not part of the cross section of FIG. 3*a*; distribution tube 813 is shown to indicate liquid can feed in either direction. Liquid then flows into surface channel 814, from which it enters porous shell 12.

Figure 3C:
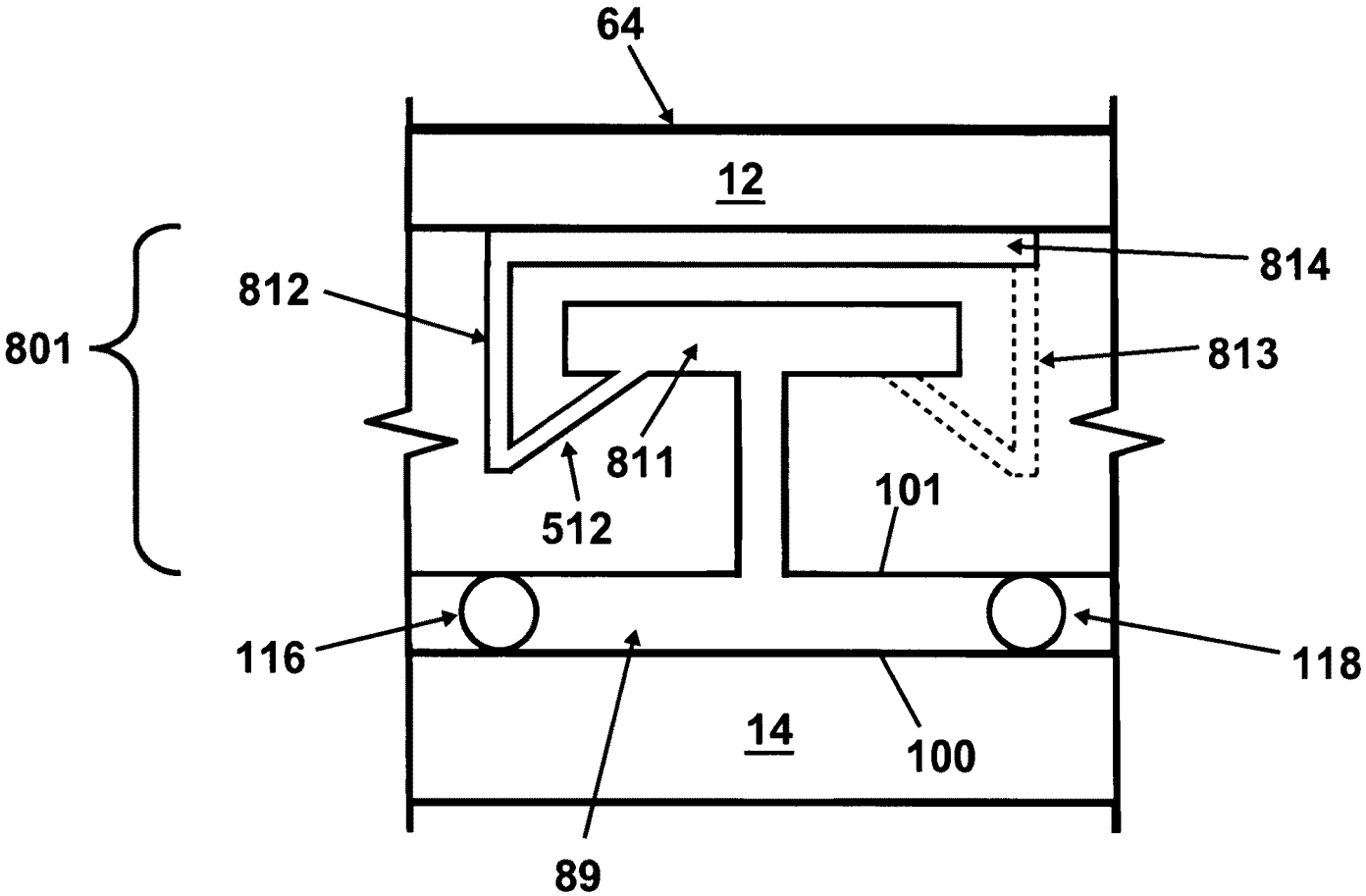
FIG. 3*c* shows the cross section of the porous roll shown in FIG. 3*b*, according to another embodiment of the present invention.

FIG. 3*c* shows the cross section of porous roll 170 shown in FIG. 3*b*, according to another embodiment of the present invention. In this embodiment, distribution ring 801 may not include pressure relief valve 803 and distribution tube 812 takes a diagonal path 512 between inner channel 811 and surface channel 814. Distribution tube 812 extends diagonally from inner channel 811 away from porous shell 12 before following a path to surface channel 814. For the embodiment shown in FIG. 3*b*, without pressure relief valves 803, liquid may tend to drain out of inner channel 811 under the action of centrifugal forces caused by rotation of porous roll 170. Diagonal path 512 may prevent liquid channel 811 from flowing to porous shell 12 solely because of centrifugal forces caused by rotation because liquid has to flow radially inward, against the centrifugal forces, prior to moving from distribution tubes 812, 813 into surface channels 814. In this embodiment, in order for liquid to pass into surface channels 814, a positive pressure may need to be supplied from a liquid pump coupled to interior tube 172 (FIG. 3*a*) to force the liquid down diagonal path 512 and out to porous shell 12.

Figure 4A:
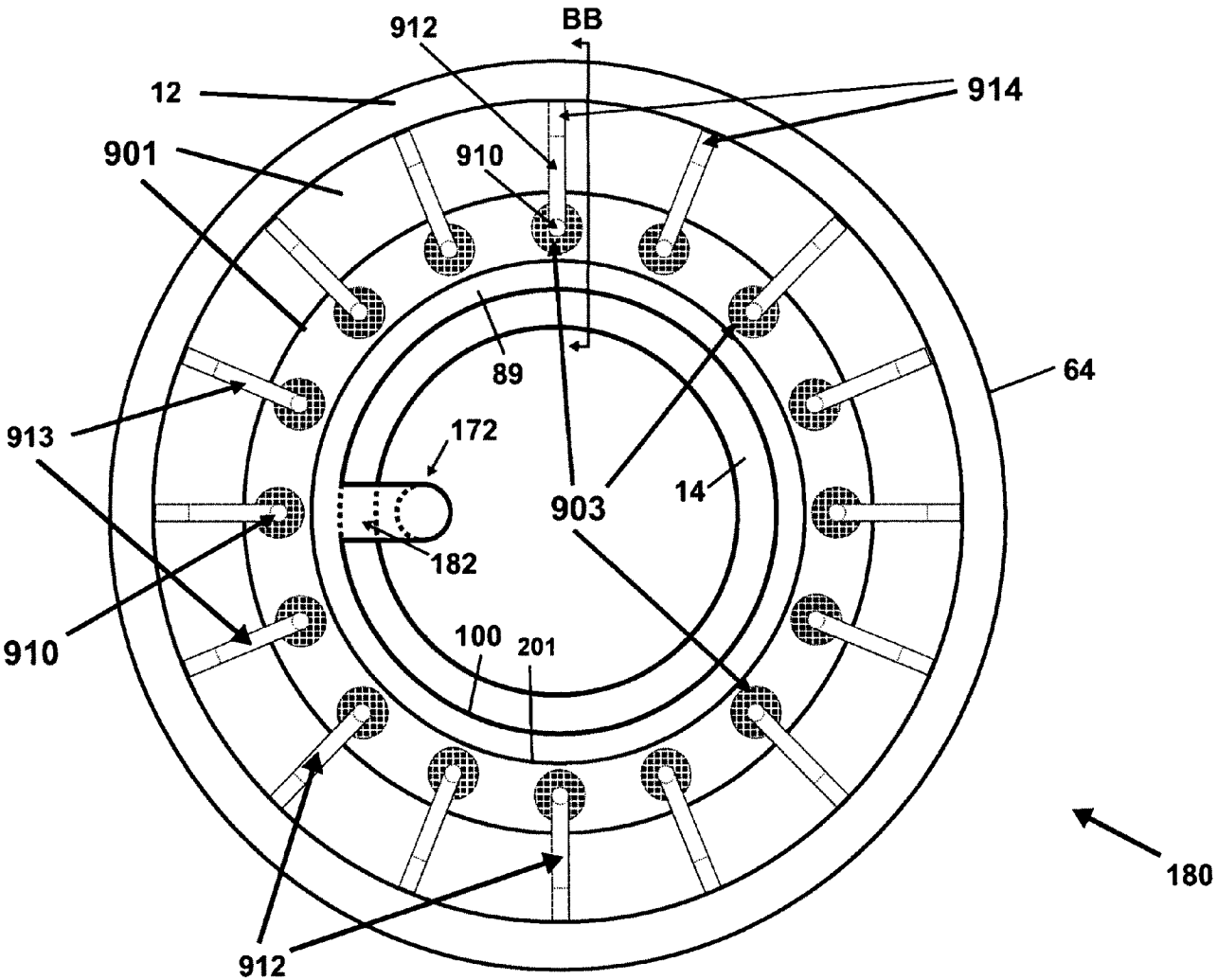
FIG. 4*a* shows a schematic view of an axial cross-section of a porous roll according to another embodiment of the present invention.

FIG. 4*a* shows a schematic view of an axial cross-section of a porous roll 180 according to another embodiment of the present invention. Porous roll 180 is similar to porous roll 10 shown in FIG. 1 and includes roll core 14 and porous shell 12. Interior tube 172 transports liquid from an axial direction and then radially towards hole 182 and through roll core 14 into liquid flow region 89. In this embodiment, check valves 903, which regulate liquid flow in a distribution ring 901, may be arranged axially with respect to a center axis of porous roll 180. When liquid in liquid flow region 89 exceeds a pre-determined pressure value, liquid may flow through check valves 903 and passages 910 directly into distribution tubes 912, 913. Distribution tubes 912, 913 may alternate about the center axis of porous roll 180 to distribute liquid to respective surface channels 914, which run parallel to the center axis of porous roll 180 and deliver liquid to porous shell 12. Ink may then be transferred through outer surface 64 to an adjacent plate cylinder. Distribution tubes 912, 913 may alternate at constant angle around the roll, meaning surface channels 914 are fed from alternating axial directions. In this embodiment, one check valve 903 may be provided for each surface channel 914.

Figure 4B:
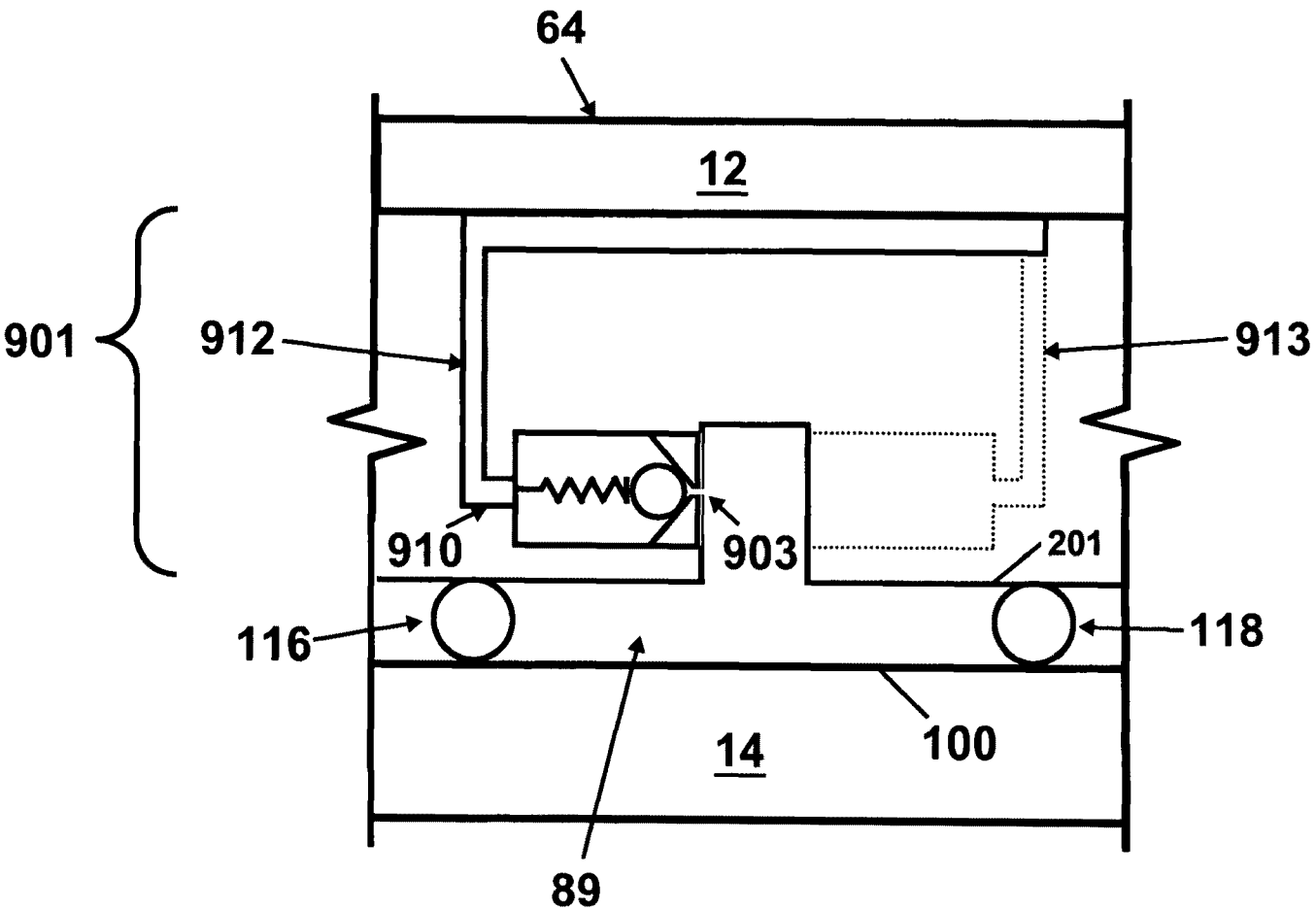
FIG. 4*b* shows a schematic view of a cross section of the porous roll shown in FIG. 4*a;*

FIG. 4*b* shows a schematic view of a cross section of porous roll 180 along BB of FIG. 4*a*. Outer surface 100 of roll core 14 and inner surface 201 of liquid distribution ring 901 are attached to two sealing elements 116, 118 which prevent liquid from flowing between liquid flow region 89 and adjacent liquid flow regions. Once liquid in liquid flow region 89 exceeds a pre-determined pressure value and axially oriented pressure relief valve 903 has opened, liquid flows through passage 910 into feeds 912, 913. Distribution tube 913 is shown dotted because it is not part of the cross section of FIG. 3*a*; distribution tube 193 is shown to indicate that check valves 903 can be arranged in different axial positions and liquid can feed in either direction. Liquid then flows into surface channel 914, from which it enters porous shell 12.

Figure 5:
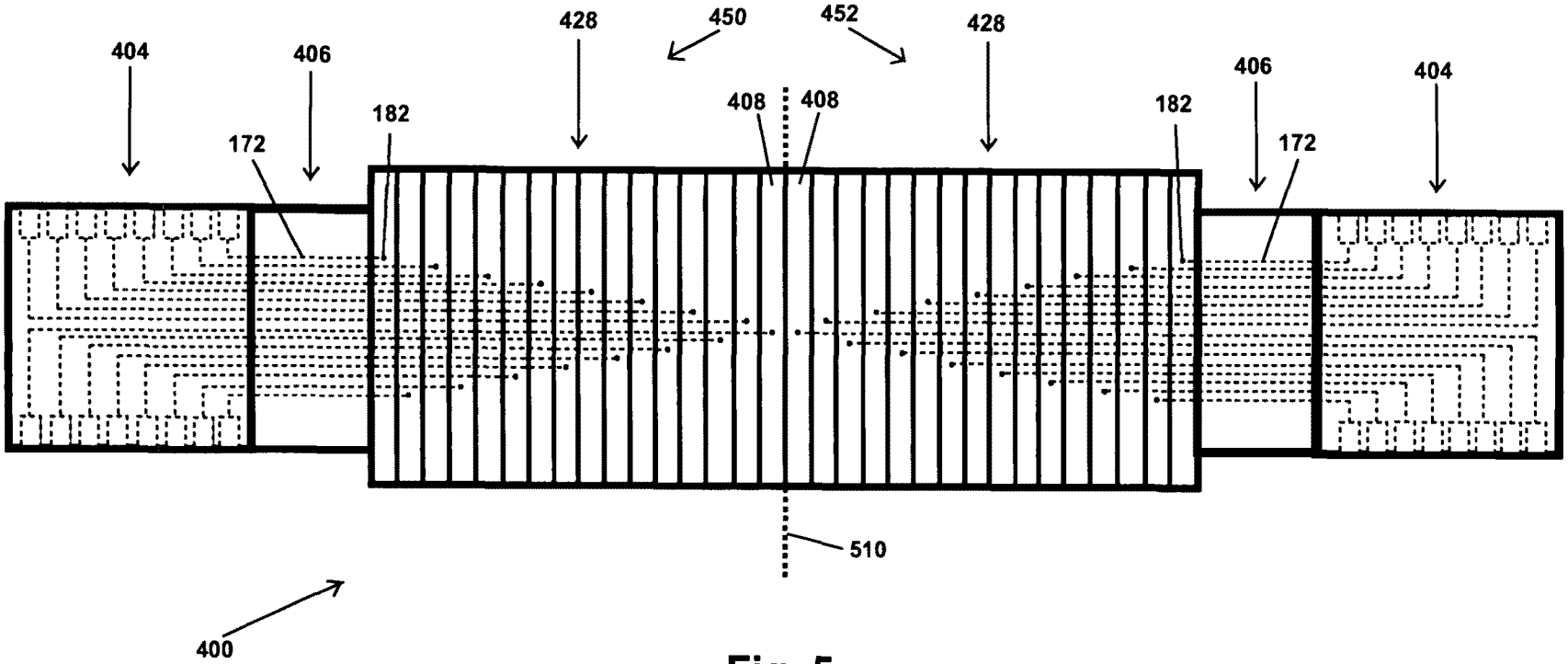
FIG. 5 shows a highly schematic side view of an inking or dampening apparatus according to an embodiment of the present invention.

FIG. 5 shows a highly schematic side view of an inking or dampening apparatus 400 according to an embodiment of the present invention. Apparatus 400 includes a gear side section 450 and a working side section 452. For illustrative purposes, sections 450, 452 are shown divided by a dotted line 510. Each section 450, 452 includes a rotary union 404, a coupling 406 and a roll section 428. Roll sections 428 may include a plurality of axial zones 408. Liquid is fed to axial zones 408 via interior tubes 172 and holes 182. Roll sections 428 may include roll core 14 and porous shell 12, which are shown in FIGS. 1, 3*a*, 4*a*, for example, and may include one or more components that aid in distributing liquid between roll core 14 and porous shell 12, such as one or more components of distribution ring 801 shown in FIGS. 3*a* to 3*c* or one or more components of distribution ring 901 shown in FIGS. 4*a*, 4*b*.

Figure 6:
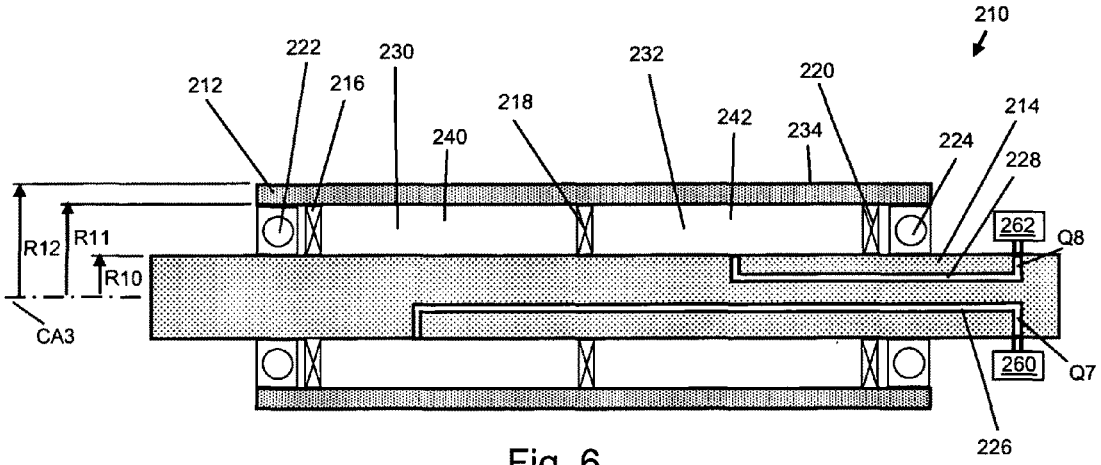
FIG. 6 shows a schematic cross-sectional side view of a porous roll according to another embodiment of the present invention.

FIG. 6 shows a schematic cross-sectional side view of a porous roll 210 according to another embodiment of the present invention. Porous roll 210 includes a porous shell 212, a roll core 214, seals 216, 218, 220, bearings 222, 224, and channels 226, 228. For clarity, FIG. 1 shows only two axial zones 240, 242 of porous roll 210, and porous shell 212 has been sectioned away to expose roll core 214, seals 216, 218, 220, and bearings 222, 224.

Porous shell 212 is supported by the outer race of bearings 222, 224 at the edges of roll core 214. Porous shell 212 may be supported by one or more additional bearings on roll core 214. Porous shell 212 is free to rotate around a center axis CA3.

Roll core 214 has an outer surface supporting the inner race of bearings 222, 224 and seals 216, 218, 220. Seals 216, 218, 220 form the axial boundaries of zones 230, 232. Zone 242 has a channel 228 internal to roll core 214, extending from outer surface of roll core 214, under bearing 224 and under seal 220, to the outer surface of roll core 214, out-board of bearing 224, delivering liquid to an interior region 232. Similarly, zone 240 has a channel 226 internal to roll core 214, extending from outer surface of roll core 214, under bearing 224 and under seals 218, 220 to the outer surface of roll core 214, out-board of bearing 224, delivering liquid to an interior region 230. Channels 226, 228 extend through roll core 214, out-board of bearing 224 and are coupled to liquid feed pumps 160, 162. Channels 226, 228 act as liquid feeds to axial zones 240, 242 respectively.

During operation of porous roll 210, liquid is pumped at controlled flowrates Q7, Q8 through channels 226, 228 and into regions 230, 232. In each zone 240, 242, the liquid may fill interior regions 230, 232 between an outer radius R10 of roll core 214, and an inner radius R11 of porous shell 212. Seal 218 prevents liquid from flowing axially between zones 240, 242. Seals 216, 220 prevent ink from flowing axially outward from zones 240, 242. Liquid essentially flows radially from regions 230, 232 through porous shell 212 to an outer surface 234 of porous shell 212 at an outer radius R12. Liquid transfers from outer surface 234 to an adjacent roller at a region of contact, or nip, formed between outer surface 234 and the adjacent roller.

By constructing porous roll 210 with porous shell 212, liquid transfer from porous roll 210 to an adjacent roller is quasi-continuous. Porous roll 210 can advantageously improve the uniformity of liquid supplied to the printing plate and allows the number of rollers to be reduced.

Liquid delivered by porous roll 210 is pre-metered by the liquid feed pumps 160, 162 coupled to channels 226, 228. At steady state operation, a flowrate of liquid out of outer surface 234 and to an adjacent roll in ink zones 240, 242 is equal to ink flowrates Q7, Q8, respectively. Porous roll 10 thus advantageously can reduce or eliminate intermittent ink feed.

While FIG. 6 shows only two zones 240, 242, porous roll 210 may contain as many zones as needed for the desired print quality. As more zones are added, additional liquid pumps, channels, and seals are added accordingly. Additional channels may also enter through the opposite axial end of roll core 214.

Figure 7:
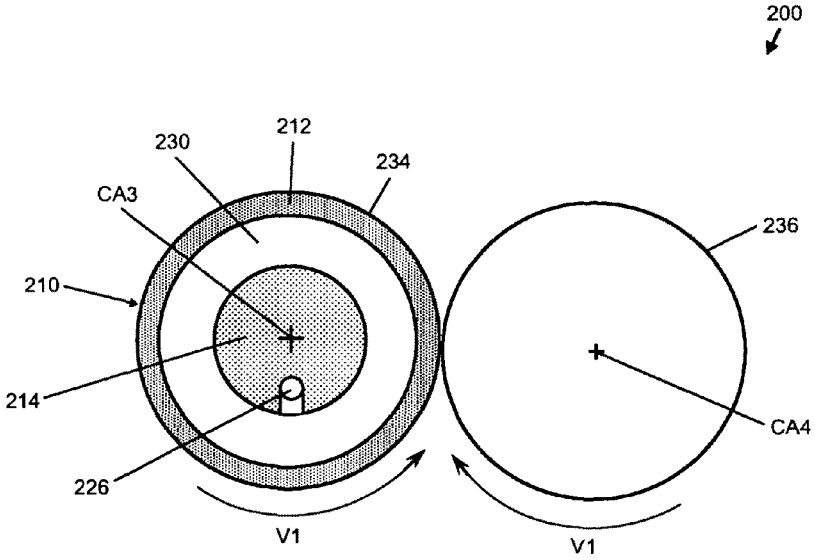
FIG. 7 shows a schematic view of an axial cross-section of an inking apparatus according to an embodiment of the present invention, including the porous roll shown in FIG. 6 and an adjacent roller.

FIG. 7 shows a schematic side view of axial cross-section of an inking apparatus 200 according to an embodiment of the present invention, having an adjacent roller 236 and porous roll 210 shown in FIG. 6. The axial cross-section of porous roll 210 shown in FIG. 7 is in axial zone 240. Adjacent roller 236 and porous shell 12 rotate about center axes CA4 and CA3, respectively, at a velocity V1.

During operation of porous roll 210, liquid is pumped through channel 226 and into region 230. In each zone, the liquid may fill region 230 between roll core 214, and porous shell 212. Liquid flows radially from region 230 through porous shell 212 to an outer surface 234 of porous shell 212. Liquid transfers from outer surface 234 to an adjacent roller at a region of contact, or nip, formed between outer surface 234 and the adjacent roller 236. Region 230 between the roll core 214 and the porous shell 212 may contain one or more components to aid in liquid distribution such as a secondary porous material, a material with channels, a void region, check valves, or any combination thereof. These one or more components may include, for example, one or more components of distribution ring 801 shown in FIGS. 3*a* to 3*c* or one or more components of distribution ring 901 shown in FIGS. 4*a*, 4*b*.

Figure 8:
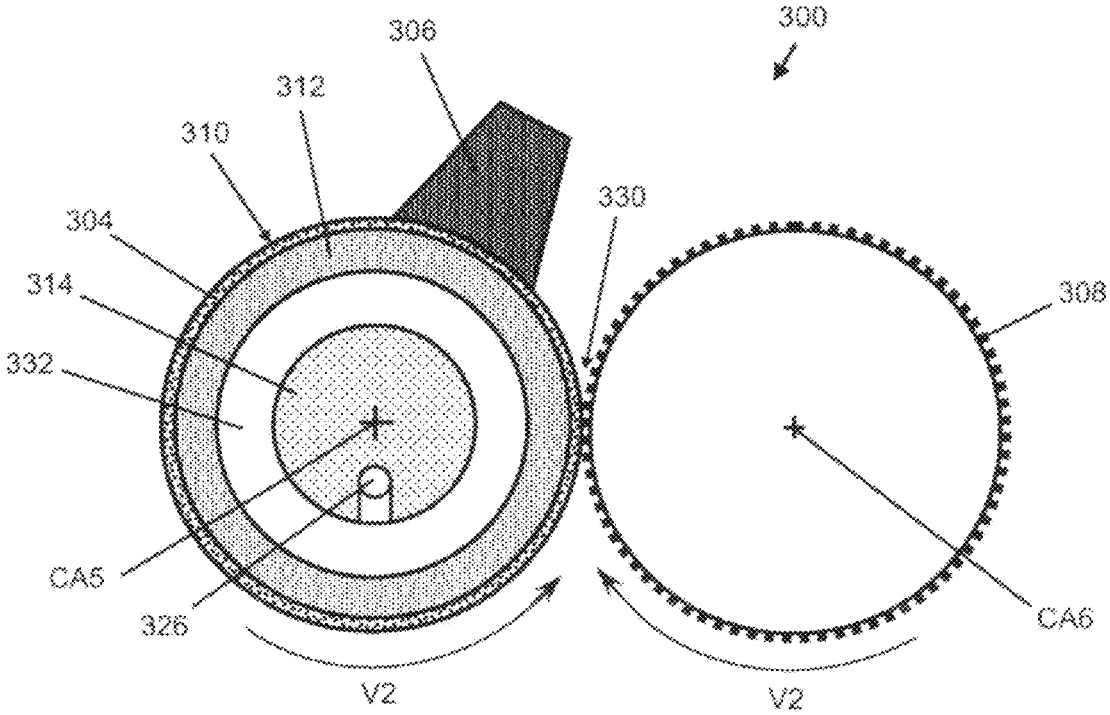
FIG. 8 shows an inking apparatus according to an embodiment of the present invention, having an anilox roll, an ink chamber and a plate cylinder.

FIG. 8 shows an inking apparatus 300 according to an embodiment of the present invention, having an anilox roll 310, an ink chamber 306 and a plate cylinder 308. Anilox roll 310 includes a roll core 314, an interior region 332, a porous layer 312 and an outer surface 304 of engraved cells. The engraved cells preferably have a cell wall thickness of less than or equal to 10 microns. Anilox roll 310 and plate cylinder 308 rotate about center axes CA5, CA6, respectively, at a velocity V2. As outer surface 304 passes under ink chamber 306, ink chamber 306 fills cells with ink and removes excess ink with a doctor blade. As outer surface 304 travels from ink chamber 306 to a nip 330 formed between anilox roll 310 and plate cylinder 308, additional ink may be supplied to outer surface 304 by pumping ink supplied to interior region 332 by a channel 326 through porous layer 312. Ink is transferred from outer surface 304 to plate cylinder 308 in nip 330. Plate cylinder 308 may be flexographic, for example.

In one preferred embodiment, anilox roll 310 is similar to porous roll 210 shown in FIGS. 6 and 7, except that anilox roll 310 includes outer surface 304. Thus, in this one preferred embodiment, roll core 314 is similar to roll core 214, interior region 332 is similar to interior region 230 and porous layer 312 is similar to porous shell 212. Anilox roll 302 may include a plurality of axial zones separated by seals and one or more ink pumps may pump ink into the axial zones.

Interior region 332 between the roll core 314 and the porous layer 312 may contain one or more components to aid in liquid distribution such as a secondary porous material, a material with channels, a void region, check valves, or any combination thereof. These one or more components may include, for example, one or more components of distribution ring 801 shown in FIGS. 3*a* to 3*c* or one or more components of distribution ring 901 shown in FIGS. 4*a*, 4*b*.

Porous shells 12, 82, 212 and porous layer 312 may be constructed of a matrix material, for example, a sintered plastic, metal or ceramic material, or may alternatively be constructed by machining pores into an originally solid shell.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A roll for distributing printing liquid in a printing press comprising:

a roll core having at least a first axial zone and a second axial zone;

a first liquid feed for feeding liquid to the first axial zone;

a second liquid feed for feeding the liquid to the second axial zone independent of the first axial zone;

a porous shell covering the first and second axial zones;

at least one first liquid distributing component in the first axial zone between an outer surface of the roll core and an inner surface of the porous shell; and at least one second liquid distributing component in the second axial zone between the outer surface of the roll core and the inner surface of the porous shell.

2. The roll recited in claim 1 further comprising a seal preventing the liquid from flowing between the first and second axial zones.

3. The roll recited in claim 1 wherein the first liquid feed includes a first interior tube feeding liquid to the first axial zone from inside of the roll core and the second liquid feed includes a second interior tube feeding to the second axial zone from inside of the roll core.

4. The roll recited in claim 3 further comprising a first liquid pump pumping liquid through the first interior tube to the first axial zone and a second liquid pump pumping liquid through the second interior tube to the second axial zone.

5. The roll recited in claim 1 further comprising a bearing allowing the porous shell to rotate around a center axis of the roll core.

6. The roll recited in claim 1 wherein the at least one first liquid distributing component includes at least one first check valve regulating the flow of liquid between the roll core and the porous shell in the first axial zone and the at least one second liquid distributing component includes at least one second check valve regulating the flow of liquid between the roll core and the porous shell in the second axial zone.

7. The roll recited in claim 6 wherein the at least one first liquid distributing component includes a first channel extending circumferentially along the inner surface of the porous shell, the liquid flowing from the roll core through the at least one first check valve to the first channel, the at least one second liquid distributing component includes a second channel extending circumferentially along the inner surface of the porous shell, the liquid flowing from the roll core through the at least one second check valve to the second channel.

8. The roll recited in claim 1 wherein the at least one first liquid distributing component includes at least one first distribution tube providing the liquid from the roll core to the porous shell in the first axial zone and the at least one second liquid distributing component includes at least one second distribution tube providing the liquid from the roll core to the porous shell in the second axial zone.

9. The roll core recited in claim 8 wherein each of the at least one first distribution tube and the at least one second distribution tube takes a diagonal path towards the roll core as the at least one first distribution tube and the at least one second distribution tube provide the liquid from the roll core to the porous shell.

10. The roll recited in claim 9 wherein the at least one first liquid distributing component includes a first channel extending circumferentially along the inner surface of the porous shell, the liquid flowing from the roll core through the at least one first distribution tube to the first channel, the at least one second liquid distributing component includes a second channel extending circumferentially along the inner surface of the porous shell, the liquid flowing from the roll core through the at least one second distribution tube to the second channel.

11. The roll core recited in claim 10 wherein the at least one first distribution tube includes a first radially extending portion connecting a portion of the at least one first distribution tube taking the diagonal path to the first channel such that printing liquid entering the at least one first distribution tube from the roll core flows radially inward toward the roll core in the portion of the at least one first distribution tube taking the diagonal path and then flows radially outward toward the porous shell in the first radially extending portion, the at least one second distribution tube includes a second radially extending portion connecting a portion of the at least one second distribution tube taking the diagonal path to the first channel such that printing liquid entering the at least one second distribution tube from the roll core flows radially inward toward the roll core in the portion of the at least one second distribution tube taking the diagonal path and then flows radially outward toward the porous shell in the second radially extending portion.

12. The roll recited in claim 8 wherein each of the at least one first distribution tube and the at least one second distribution tube provides the liquid from the roll core to the porous shell by following a path that prevents the liquid from flowing to the porous shell solely because of centrifugal forces caused by rotation of the roll.

13. The roll recited in claim 12 further comprising at least one liquid pump pumping liquid from the roll core to the porous shell and providing a positive pressure to the at least one first distribution tube and the at least one second distribution tube, the positive pressure causing liquid to flow through the at least one first distribution tube and the at least one second distribution tube to the porous shell.

14. The roll recited in claim 1 wherein the liquid is ink.

15. The roll recited in claim 1 wherein the liquid is dampening fluid.

* * * * *

UNITED STATES PATENT AND TRADEMARK OFFICE

CERTIFICATE OF CORRECTION

PATENT NO. : 8,342,092 B2
APPLICATION NO. : 12/313565
DATED : January 1, 2013
INVENTOR(S) : Kent Dirksen Kasper et al.

It is certified that error appears in the above-identified patent and that said Letters Patent is hereby corrected as shown below:

On the title page, item (54) and in the specification, column 1, line 1, Title should read:

"POROUS ROLL WITH AXIAL ZONES AND METHOD OF PROVIDING PRINTING LIQUID TO A CYLINDER IN A PRINTING PRESS"

instead of

"POROUS ROLL WITH AXIAL ZONES AND METHOD OF PROVING PRINTING LIQUID TO A CYLINDER IN A PRINTING PRESS"

Signed and Sealed this
Eighteenth Day of June, 2013

Teresa Stanek Rea

Teresa Stanek Rea
*Acting Director of the United States Patent and Trademark Office*